United States Patent [19]

Carroll

[11] Patent Number: 4,967,098

[45] Date of Patent: Oct. 30, 1990

[54] CONTROLLER FOR OUTDOOR LIGHTING SYSTEMS

[75] Inventor: David T. Carroll, Sonoma, Calif.

[73] Assignee: GardenAmerica, Carson City, Nev.

[21] Appl. No.: 195,080

[22] Filed: May 17, 1988

[51] Int. Cl.[5] ..... H01H 43/00; G04C 23/00; H05B 37/02

[52] U.S. Cl. ..... 307/140; 307/141; 315/360

[58] Field of Search ..... 307/140, 141, 39, 40, 307/132 E; 315/291, 360

[56] References Cited

U.S. PATENT DOCUMENTS 4,354,120 10/1982 Schornack ..... 307/140 X

*Primary Examiner*—William M. Shoop, Jr.
*Assistant Examiner*—Sharon D. Logan
*Attorney, Agent, or Firm*—Blakely, Sokoloff, Taylor & Zafman

[57] ABSTRACT

A controller for outdoor lighting systems turns lights on and off at predetermined times during the day which are designated by a user. The turn on time is set when the user first turns on the lights. The turn off time is fixed by allowing the user to specify the amount of time that the lights will stay lit. The controller repeats the on-off sequence every 24 hours unless it is reprogrammed. Accurate timing is maintained by counting the pulses in standard 120 V, 60 Hz, line current. A manual override is provided which does not interfere with the programmed time sequence.

7 Claims, 2 Drawing Sheets

22
29
28
27
26
25
32
31
30
36
37
57
56
55
34a
34b
34c
34d
34e
34f
34g
34h
40
41
42
43
44
45
46
47
48
49
50
51
52
21
20
19
17
18
11
15
12
39
38
13
14
16
10

CONTROLLER FOR OUTDOOR LIGHTING SYSTEMS

FIELD OF THE INVENTION

The invention relates to the field of controllers for electrical devices, and more particularly to controllers for outdoor lighting systems.

BACKGROUND OF THE INVENTION

There are many uses for outdoor lighting systems. Many people find it desirable to have outdoor lights around their house. These lights add aesthetics to the house, provide an element of security by illuminating dark areas, and often increase the value of house and property. Parks and other public areas also benefit from the use of outdoor lights.

One limitation on the use of outdoor lights, however, is a mechanism for turning them on and off. It is usually not desirable to have the lights stay on all night, as this results in increased power usage and attendant costs.

Previous types of outdoor lighting controllers utilized a photocell to turn the lights on and off. As evening approached, the light falling on the photocell decreased. When the photocell sensed a certain level of dimness, the lights were turned on. The lights remained on until the photocell sensed that the amount of light falling on the photocell had reached a certain brightness. This type of controller had the limitations of keeping the lights on all night and not allowing the user to turn the lights on at any given time. The present invention overcomes these limitations by allowing the user to turn the lights on at any desired time and specify the amount of the time that the lights will remain lit.

SUMMARY OF THE INVENTION

The present invention comprises a controller for outdoor lighting systems. The controller allows the lights to be turned on and off at predetermined times that are designated by a user. The user turns the lights on and selects how many hours the lights are to remain lit. After the selected number of hours, the lights automatically turn off. The turn-on/turn-off sequence repeats every 24 hours unless the controller is reprogrammed. The controller monitors accurate timing by counting pulses in standard 120 volt, 60 Hertz, AC. A manual override is provided that does not interfere with the programmed times.

The controller of the present invention overcomes problems that are present in prior outdoor lighting systems. The automatic turn-off feature eliminates the need for the user to manually operate the lights. Because the controller's programmed sequence repeats every 24 hours, the user can set the controller once and the lights will automatically turn on at the selected time each day, and then automatically turn off after they have been lit the desired amount of time. The present invention also overcomes the problems of prior photocell type controllers which keep lights turned on all night. With the present invention, the user can program the lights to turn on at dusk, and remain on for only a few hours, as opposed to staying on until dawn. For example, a user may wish to turn the lights on at 8:00 p.m. and have them remain lit for 2 hours. This results in reduced power consumption and less cost to the user.

BRIEF DESCRIPTION OF THE DRAWINGS

FIG. 1 is a functional block diagram of the present invention.

DETAILED DESCRIPTION OF THE INVENTION

Figure 2:
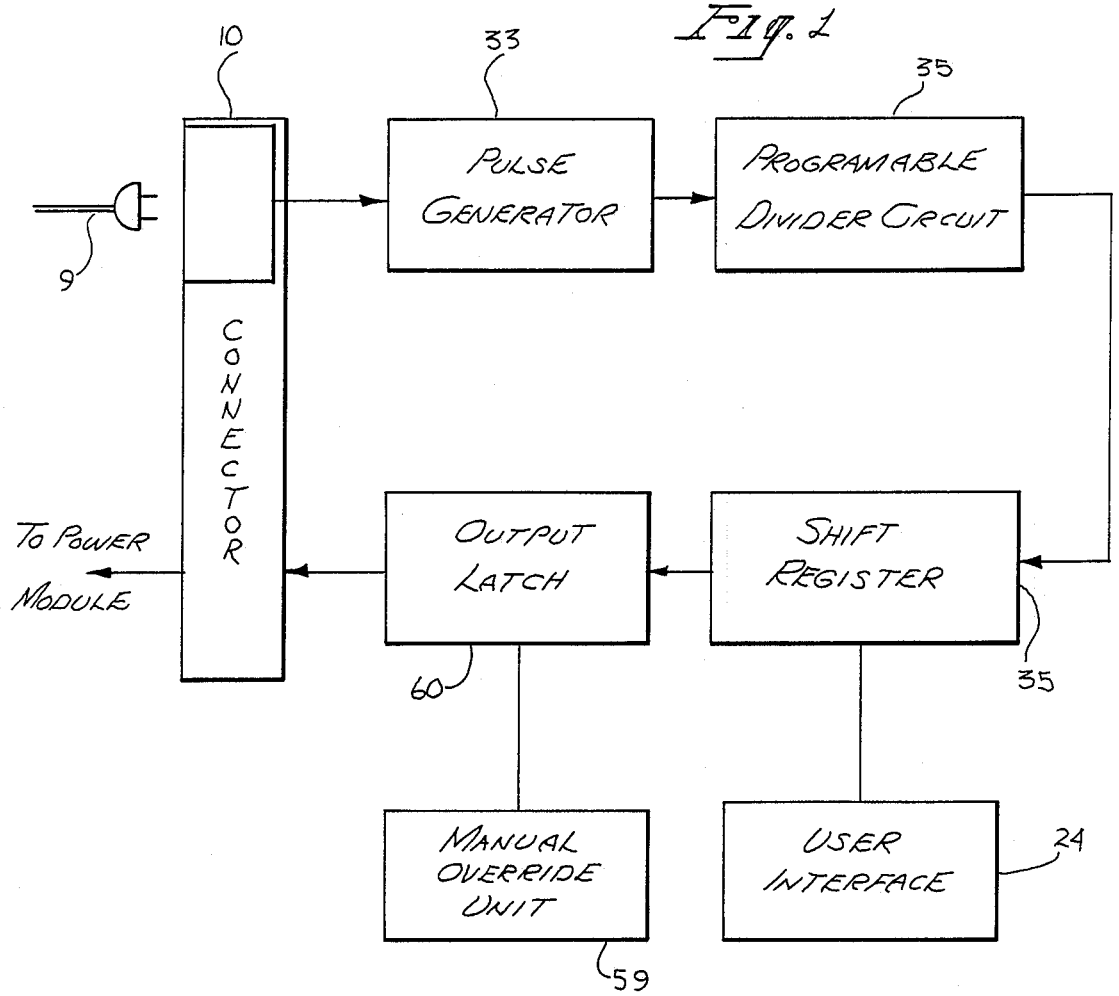
FIG. 2 is an electronic schematic of the preferred embodiment of present invention.

An electrical controller for the control of outdoor lighting systems is described. Throughout the description the same numbers are used to designate the same elements of the invention.

Referring first to FIG. 1, a functional block diagram at the present invention is illustrated. The main elements of the controller are the pulse generator 23, the programmable divider circuit 33, the shift register 35 and the output latch 60. Power is supplied to the controller through the connector 10 from the power cord 9. The pulse generator 23 changes ordinary household current (120 volts AC) into a square wave pulse train. These pulses are then counted by the programmable divider circuit 33 which, in the preferred embodiment, generates an output pulse once every hour.

The shift register 35 contains a number of bits arranged in a serial manner. The preferred embodiment utilizes 24 bits—one for each hour of the day—but a different number can be used. The value of the bits in the shift register 35 are either 0 or 1. When the shift register 35 receives an output pulse from the programmable divider circuit 33, the contents of the shift register are shifted one position to the left. The contents of the most significant, or leftmost, bit moves to the least significant, or rightmost, position.

The output latch 60 monitors the most significant bit location. When the contents of this location change from a 0 to a 1 the output latch 60 generates a signal that turns the lights on. When the contents of the most significant bit changes from 1 to 0 the output latch turns off the lights. A manual override unit 59 is connected to the output latch. The manual override allows the lights to be turned on and off without affecting the timing circuits.

The user interface 24 performs two main functions. First it turns the lights on and initiates the timing sequence by resetting the programmable divider circuit 33 and the shift register 35. Second, it sets the value of at least one of the bits contained in the shift register to a value of 1. In the preferred embodiment the user interface 24 sets the most significant bit and up to seven additional bits to a value of 1, and the remaining bits to a value of 0. The bits set to a value of 1 are all adjacent to each other. Thus, the preferred embodiment allows the user to program the controller to keep the lights on for a total of seven hours.

Figure 3:
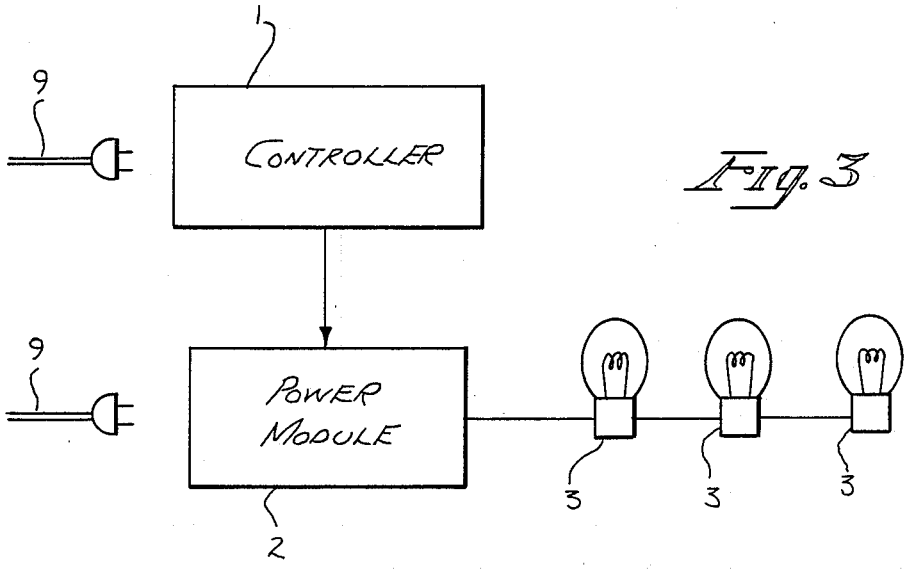
FIG. 3 is a block diagram showing the relationship between the present invention and other elements of an outdoor lighting system.
Figure 2:
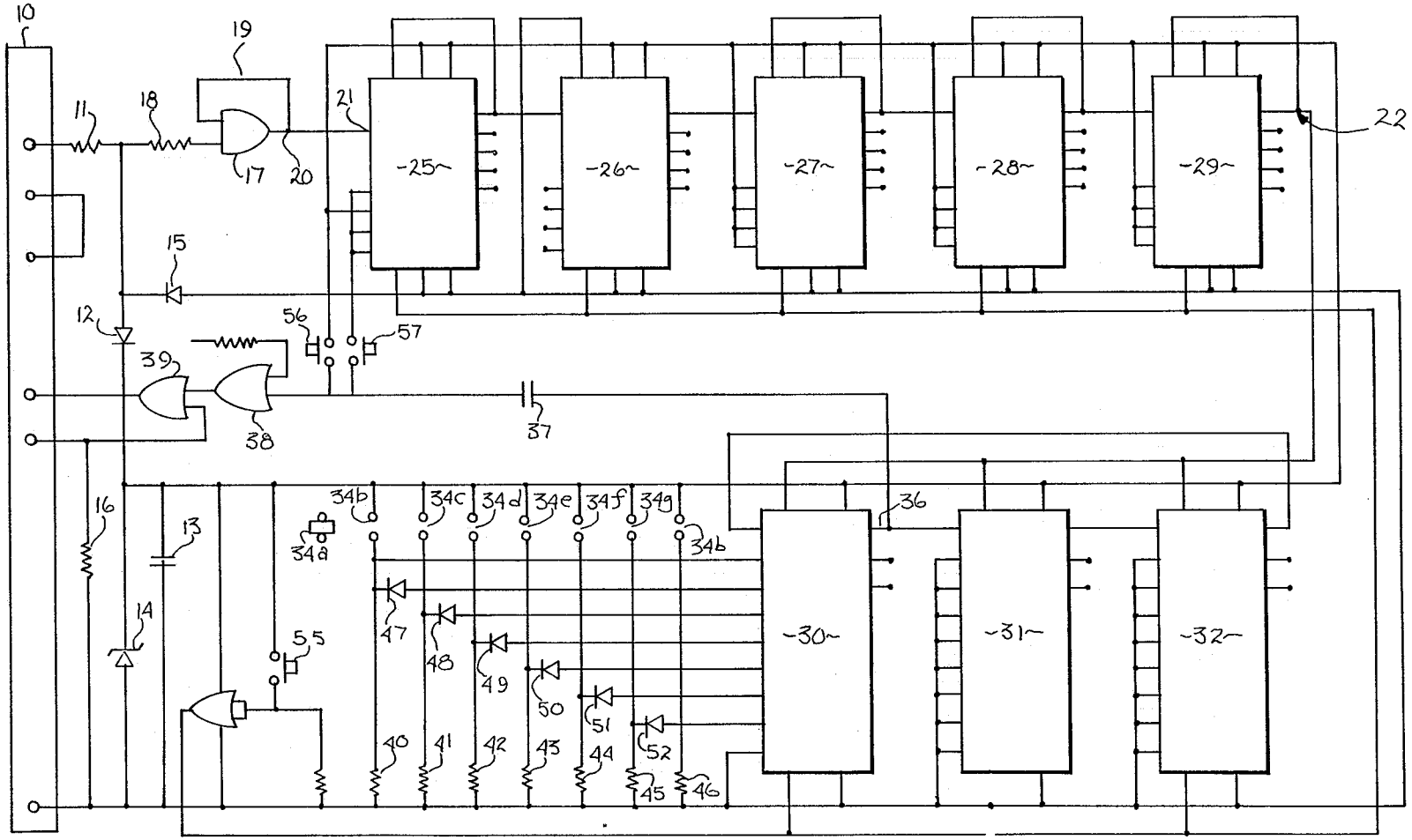

The present invention is only one element of an outdoor lighting system. FIG. 3 shows a typical system incorporating the present controller 1. The system illustrated also has a power module 2 and the lights themselves 3. As shown, the controller does not actually drive the lights, but drives the power supply. It is to be understood that when the present description states that the controller "turns on" or "turns off" the lights 3, it may either do so directly or send a signal to the power supply to turn the lights on or off.

A more detailed description at the invention will now be provided with reference to FIG. 2. Power enters the controller through the power cord 9 and connector 10. In the preferred embodiment the 120 volt AC power is applied across connector pins 10*a* and 10*f*, with ground being connected to connector pin 10F. Resistor 11 and diode 12 are used to half-wave rectify the AC signal and present a low voltage direct current signal to capacitor means 13 and zener diode 14. The voltage level at the anode of diode 12 changes from a low value to a high value as the half-wave rectified AC signal rises. In the preferred embodiment, the input frequency of the AC signal is 60 Hertz and the anode of the diode 12 changes to a high state approximately every 16.67 milliseconds. The change in state at the anode of diode 12 is sensed by the input of logic gate 17. In the preferred embodiment logic gate 17 is an OR gate. Resistor 18 and capacitor 19 provide filtering and hysteresis such that a clean filtered square wave signal is present at the output 20 of the OR gate 17.

Integrated circuits 25–29 are counters which form a programmable divider circuit. The input 21 to the programmable divider circuit is connected to the output of the OR gate 17. The programmable divider circuit counts the number of pulses output from the OR gate, and, after a predetermined number of pulses, outputs a signal at the output 22 of the programmable divider circuit. In the preferred embodiment, the programmable divider circuit counts 216,000 input pulses before generating an output pulse. Since the preferred embodiment inputs a pulse to the programmable divider circuit approximately each 16.67 milliseconds, the programmable divider circuit generates an output pulse once every hour. It will be appreciated by those skilled in the art that different numbers of input pulses may be counted in order to generate output pulses at different time intervals.

The output 22 of the programmable divider circuit is connected to a serial shift register, which in the preferred embodiment, is comprised of integrated circuits 30–32. Each of the integrated circuits 30–32 is an 8 bit parallel load serial shift register and in the preferred embodiment the registers connected serially. Thus, a single 24 bit serial shift register is created. For the purposes of this disclosure, the bits in the shift register will be described as being arranged in a horizontal, left to right relationship with the most significant bit being the leftmost bit.

Whenever an output pulse appears at the output 22 of the programmable divider circuit 33, the bits in the shift register change position. Each bit moves one position to the left with the leftmost bit rotating to the rightmost position. Thus, in the preferred embodiment, the bits change position once each hour. One bit location is monitored as the output 36 of the serial shift register 35. In the preferred embodiment, the most-significant bit is monitored.

The signal at output 36 of the shift register passes through signal line 62 to the output latch 60. The output latch acts as an edge triggering device. Resistor 66 provides a feedback signal to OR gate 38. Because of the feedback, the output of OR gate 38 will only change state when signal line 62 changes. When the output of the shift register 35 changes from a low value to a high value, the output of OR gate 38 latches at a high value. Conversely, when the output of the shift register 35 changes from a high value to a low value, the output of OR gate 38 latches at a low value. The output of OR gate 38 is fed into OR gate 39. The output of OR gate 39 is connected to the connector 10 at the connector pin 10*d*. When the output of the OR gate 39 is high, the lights are on. When the output is low the lights are off. When the programmed number of hours have passed, the output of the shift register will change to a low value thus turning the lights off.

The operation of the user interface 24 will now be described. The user interface consists of switches 34 and 55 and AND gate 54. In the preferred embodiment, switch 55 is normally open and is of the momentary contact type. The inputs to AND gate 54 are pulled low through resister 53 when switch 55 is open. Thus, the output of AND gate 54 is also held low. When Switch 55 is closed, the inputs of AND gate 54 are high and the output of AND gate 54 is consequently pulled high. This signal travels over reset line 61 to integrated circuits 25–29 which comprise the programmable divider circuit and integrated circuits 30–32 which comprise the shift register. A high signal level on the reset line causes the dividers in the programmable divider circuit to be reset to zero. This initiates the timing sequence. Also, each of the 24 bits in the shift register is loaded with a value of 0 or 1 as will be more fully described below. Closing of switch 55 also causes a high signal to appear at the output 36 of the shift register 35, which, as described above, causes output latch 60 to generate a signal which turns the lights on.

The manner in which the bits are loaded into the shift register will now be described. In the preferred embodiment, the inputs 31*a*—31*h* and 32*a*—32*h* to the 8-bit shift registers on integrated circuits 31 and 32 are tied to ground through lines 63 and 64, respectively. Also, the input 30*h* to bit number 8 of the 8-bit shift register on integrated circuit 30 is tied to ground through line 65. This causes the least significant 17 bits of the 2 bits in the shift register 35 to be set to zero when switch 55 is closed. In the preferred embodiment, these comprise bits 8–24. The preferred embodiment thus allows bits 1–7 of the 24 bit register to be programmed with either a 0 or 1 depending on how long the user desires the lights to remain turned on.

Bits 1–7 are programmed with the use of switch 34 and diodes 47–52. In the preferred embodiment, switch 34 is a slide switch with seven selectable positions. When the switch 34 is in position 34*i* all of the inputs 30*a*–30*g* are tied to ground through resisters 40–46. However, when switch 34 is in any other position, some of the inputs are connected to a voltage on line 63. For example, when switch 34 is in position 34*c*, input 30*c* is connected directly to voltage line 63. Also, current flows through diodes 47 and 48 and resistors 40 and 41, thereby causing high signals to appear at inputs 30*a* and 30*b* as well as 30*c*. Inputs 30*d*–30*g* are isolated by means of diode 49, which is reverse-biased, and remain tied to ground through resistors 43–46. Therefore, when switch 34 is in position 34*c* and switch 55 is closed thereby enabling shift register to be loaded, a value of 1 is loaded into the three most significant bits of the shift register and the remaining bits are loaded with a value of zero.

Every hour, a pulse from the programmable divider circuit 33 will shift the bits in the shift register one bit to the left. Thus in the foregoing example, after three hours, the most significant bit in the shift register 33 will change to a low value. As described above, this will cause the output latch to generate a signal to turn the lights out. Since there are 24 total bits in the shift register 33, the bits will return to their original positions in 24 hours, or one day, after the lights are initially turned on. At that time the most significant bit will go high and the lights will turn on. A specific illustration of the use of the present invention will be given in the following example. A user may wish to have the lights turn at 8:00 p.m. and stay lit for 3 hours. To do this, the user would simply set switch 34 in position 34c and wait until 8:00 p.m. At that time, the user would press Switch 55, thus turning on the lights. The lights would remain on for 3 hours. The next day, the lights would again turn on at 8:00 p.m. and stay lit for 3 hours. This sequence would repeat until the controller was reprogrammed.

A manual override is provided by switches 56 and 57. Switch 56 presents a high value to the input of the OR gate 38. Switch 57 presents a low value to the input of the OR gate 38. As described above, the output of OR gate 38 will latch in a particular state because of the feedback through resistor 66. Thus, when the lights are turned on or off by switches 56 or 57, respectively, they will stay in that condition until signal line 62 changes state or a switch is activated. These switches thus allow the lights to be turned on and off without affecting the timing circuit.

The foregoing description of the invention has set forth specific details regarding specific components and arrangements of the present invention. In other instances, details of well-known components have been ommitted so as not to unneccessarily obscure the invention. For example, in the preferred embodiment, all of the integrated circuits use CMOS technology. Each chip has buffered inputs with diode clamps. This prevents the signals entering the chips from exceeding a predetermined voltage range and prevents noise spikes. It will be apparent to those skilled in the art that these details can be changed without departing from the spirit of the present invention. For example, and without limitation, in the user interface 24 the switch 34 may be of the rotary or push-button type and additional bits may be programmed, allowing the lights to remain on for longer periods. Also, more than 24 bits may be employed in the shift register. For example, 48 bits would allow the user to program the controller to turn the lights off at 30 minute intervals as opposed to one hour intervals. Any of these options may be employed by those skilled in the art as a matter of design choice, without departing from the spirit of the present invention.

I claim:

1. An electronic, 24-hour, timed controller for turning lights in an outdoor lighting system on and off, said controller comprising:

connector means for accepting a substantially 120 volt alternating current from an external source;

pulse generator means coupled to said connector means for generating a series of pulses at a substantially 60 Hertz rate, said series of pulses being a square wave pulse train, said pulse generator comprising a diode and a register coupled to an OR gate and having an output;

a programmable divider circuit coupled to said output of said pulse generator for counting a predetermined number of said pulses and outputting a first signal after a predetermined time interval;

a shift register comprised of three 8-bit serial shift registers coupled serially and coupled to said programmable divider circuit, said shift register containing 24 bits which are capable of having either a first value or a second value wherein one of said bits is a most significant bit, one of said bits is a least significant bit, and said bits are arranged in a most significant to a least significant relationship, and wherein said bits in said shift register shift from a given position to a next most significant position when said programmable divider circuit outputs said first signal;

latch means coupled to said shift register for monitoring said most significant bit and generating a second signal when said most significant bit changes from said first value to said second value, said lights turning on in response to said second signal, and for generating a third signal when said most significant bit changes from said second value to said first value, said lights turning off in response to said third signal;

program means connected to said shift register means for turning on said lights and setting at least one of said bits to said first or second value according to a user input; and override means connected to said latch means for manually turning said lights on and off without interfering with said pulse generator, said programmable divider circuit, or said shift register.

2. The device of claim 1 wherein said shift register further comprises a plurality of inputs such that there is one input corresponding to each of said of bits.

3. The device of claim 2 wherein said user interface comprises a first switch, and a second switch, wherein said first switch is normally open and said second switch is adapted to be placed in one of a plurality of selectable positions, each of said selectable positions coupled through one of a plurality of resistors to ground and through one of a plurality of diodes to one of said inputs to said shift register, such that when one of said selectable positions is selected and said first switch is closed said input coupled to said selected position and all of said inputs corresponding to said bits which are more significant than said bit that corresponds to said input connected to said selected position are coupled to a voltage.

4. The device of claim 3 wherein said plurality of selectable positions comprise seven selectable positions.

5. The device of claim 1 wherein said latch means comprises a flip-flop, said flip-flop being coupled to said output of said shift register.

6. The device of claim 5 wherein said override means comprises normally open first and second switches such that when said first switch is closed said flip-flop is connected to ground and when said second switch is closed said flip-flop is connected to a voltage.

7. A controller for an outdoor lighting system, said system having at least one light, said controller comprising:

a timer;

a counter means coupled to said timer for generating a timing signal at predetermined time intervals;

a shift register means coupled to said counter means for generating an on-off signal for said at least one light, said shift register means comprising a plurality of bits, one of said bits being a most significant bit, wherein each of said bits has an initial position in said shift register and said bits are adapted to have a first or a second value, and wherein said plurality of bits change position when said counter means generates said timing signal, said shift register having an output, said output being connected to said most significant bit;

a latch means connected to said output of said shift register means, said latch means generating a turn on signal for said lights when said output changes form said first value to said second value and generating a turn off signal for said lights when said output changes from said second value to said first value, a programming means comprising a switch having a plurality of selectable positions and a resistor-diode network connected to said output of said shift register means for simultaneously turning on said lights and setting at least one of said bits in said shift register to said first value according to a user interface;

wherein said bits change position is response to said timing signal such that said latch means generates a turn on signal for a number of said predetermined time intervals equal to said number of bits set to said first value; and override means connected to said latch means such that said lights may be turned on and off according to a user input.

* * * * *